US010392241B2

(12) United States Patent
Larsson et al.

(10) Patent No.: US 10,392,241 B2
(45) Date of Patent: Aug. 27, 2019

(54) DEVICE FOR HANDLING AT LEAST ONE HOSE AND A FUEL DISPENSING UNIT HAVING SUCH A DEVICE

(71) Applicant: Wayne Fueling Systems Sweden AB, Malmö (SE)

(72) Inventors: Bengt I. Larsson, Skivarp (SE); Nina Ohlin, Lund (SE); David Sanchez Molinero, Malmö (SE)

(73) Assignee: Wayne Fueling Systems Sweden AB, Malmö (SE)

( * ) Notice: Subject to any disclaimer, the term of this patent is extended or adjusted under 35 U.S.C. 154(b) by 110 days.

(21) Appl. No.: 15/565,506

(22) PCT Filed: Apr. 20, 2016

(86) PCT No.: PCT/EP2016/058768
§ 371 (c)(1),
(2) Date: Oct. 10, 2017

(87) PCT Pub. No.: WO2016/169988
PCT Pub. Date: Oct. 27, 2016

(65) Prior Publication Data

US 2018/0079638 A1 Mar. 22, 2018

(30) Foreign Application Priority Data

Apr. 21, 2015 (SE) ..... 1550470

(51) Int. Cl.
*B67D 7/40* (2010.01)
*B65H 75/36* (2006.01)
*B67D 7/04* (2010.01)

(52) U.S. Cl.
CPC ..... *B67D 7/40* (2013.01); *B65H 75/368* (2013.01); *B67D 7/04* (2013.01); *Y10T 137/6921* (2015.04); *Y10T 137/6943* (2015.04)

(58) Field of Classification Search
CPC ..... B67D 7/40; Y10T 137/6921; Y10T 137/6943; B65H 75/368
See application file for complete search history.

(56) References Cited

U.S. PATENT DOCUMENTS 4,131,218 A * 12/1978 Tatsuno ..... B67D 7/38 137/355.16
5,651,478 A * 7/1997 Tatsuno ..... B60S 5/02 222/135

(Continued)

FOREIGN PATENT DOCUMENTS

| | | |
|---|---|---|
| EP | 2147892 | 1/2010 |
| GB | 782882 | 1/1956 |
| JP | 3075059 | 8/2000 |

*Primary Examiner* — Kevin F Murphy
(74) *Attorney, Agent, or Firm* — Mintz Levin Cohn Ferris Glovsky and Popeo, P.C.

(57) ABSTRACT

Devices and methods are provided for handling at least one hose on a fuel dispensing unit. In one embodiment, a device for handling a hose includes a hollow frame element having a first and second outer ends. A first guiding element can be arranged in the frame element, and an elastic element can extend horizontally in the frame element from a first fastening point to a second fastening point. The elastic element can be guided by the first guiding element. The device can also include a first hose guide adjacent to the first end of the frame element for guiding the at least one hose. The first fastening point can be positioned on the first hose guide such that the first hose guide is movable away from the frame element allowing the at least one hose to be pulled from an idle position to an operating position.

16 Claims, 7 Drawing Sheets

(56) References Cited

U.S. PATENT DOCUMENTS

| | | | | |
|---|---|---|---|---|
| 5,727,765 | A * | 3/1998 | Alvern | B67D 7/32<br>222/529 |
| 5,775,354 | A * | 7/1998 | Upton | B65H 75/48<br>137/1 |
| 6,199,579 | B1 * | 3/2001 | Taylor | B67D 7/40<br>137/355.22 |
| 6,230,939 | B1 * | 5/2001 | Willeke | B60S 5/02<br>137/234.6 |
| 6,328,060 | B1 | 12/2001 | Smith | |
| 8,230,876 | B2 * | 7/2012 | Gunnarsson | B67D 7/40<br>137/355.23 |
| 9,702,493 | B2 * | 7/2017 | Martensson | B67D 7/04 |

* cited by examiner

DEVICE FOR HANDLING AT LEAST ONE HOSE AND A FUEL DISPENSING UNIT HAVING SUCH A DEVICE

CROSS-REFERENCE TO RELATED APPLICATIONS

This application is a national stage application, filed under 35 U.S.C. § 371, of PCT International Patent Application No. PCT/EP2016/058768, filed on Apr. 20, 2016, and claims the benefit of priority to Swedish Patent Application No. 1550470-7, filed on Apr. 21, 2015, both of which are hereby incorporated herein by reference in their entireties.

TECHNICAL FIELD

The invention relates to a device for handling at least one hose, and a fuel dispensing unit having such a device.

BACKGROUND ART

A fuel dispensing unit, such as a petrol pump typically comprises a pump part standing on the ground, a display part positioned above the pump part and showing the chosen type of petrol, cash readout, volume readout etc., and a column or frame to which one or more petrol hoses are connected.

When the tank of a vehicle is to be filled up, the driver parks the vehicle beside the petrol pump and opens the cover or cap of the petrol tank. The driver then selects the desired type of petrol and places the pump nozzle in the inlet of the vehicle's petrol tank and puts in the desired volume of petrol.

A difficulty that may arise in connection with filling-up is that the hose does not reach to the vehicle if parked a distance from the petrol pump. The reason why the vehicle has not been parked sufficiently close to the pump may be difficulty in maneuvering owing to a limited space round the petrol pump. To allow the hose to reach the vehicle, it is usually necessary for the driver to park his vehicle so that the side of the vehicle where the filler cap is positioned faces the petrol pump. It is not always known to a driver of an unfamiliar vehicle whether the filler cap is positioned on the left or right side. This may result in the driver by mistake parking the vehicle on the wrong side of the pump and thus not being able to fill up the tank without moving the vehicle to the other side of the petrol pump since the hose does not reach all the way round the vehicle.

One way of facilitating access to the petrol pump is to provide it with a longer hose. This may, however, cause problems since a longer hose may tend to land on the ground when not used and thus get stuck in or be damaged by passing cars or other vehicles. To prevent this, the fuel dispensing unit may be provided with some kind of returning mechanism for the hose.

A problem common for the hose returning devices described above is their size, or their extension within the fuel dispensing unit, which results in bulky and complicated structures.

SUMMARY OF THE INVENTION

It is an object of the present invention to provide an improvement of the dispensing units according to prior art. A particular object is to provide a space efficient device for handling a hose of a fuel dispensing unit.

According to a first aspect, these and other objects, and/or advantages that will be apparent from the following description of embodiments, are achieved, in full or at least in part, by a device for handling at least one hose. The device comprises a frame element being hollow and having a first outer end and a second outer, said second outer end being opposite to said first outer end, a first guiding element arranged in said frame element, an elastic element extending in a substantially horizontal direction in said frame element from a first fastening point to a second fastening point, said elastic element being guided by said guiding element, and a first hose guiding means being arranged adjacent to first end of said frame element and adapted to guide said at least one hose. The first fastening point is positioned on said first hose guiding means, such that said first hose guiding means is movable away from said frame element allowing said at least one hose to be pulled from an idle position to an operating position. This is advantageous in that an extremely space efficient device for hose handling is provided, which device enables a smooth and flexible handling of the hose. Further, due to the design of the frame element and the guiding element included therein, the risk of the components of the device entangling with each other or with the hose is eliminated.

The second fastening point may be a fixed point in said frame element, which is an easy and cost effective embodiment of the invention.

In another embodiment, the second fastening point may be positioned on a second hose guiding means for guiding a second hose, such that said second hose guiding means is movable away from said frame element allowing said second hose to be pulled from an idle position to an operating position. With such a construction, one single elastic element is used for the handling of two different hoses in the fuel dispensing unit. Not only is the solution space efficient but it also requires a smaller amount of components which will save costs relating to both manufacturing and mounting of the device.

The second hose guiding means may be arranged adjacent to said second outer end of said frame element. Here, the same elastic element is used to handle two different hoses of the fuel dispensing unit, wherein the hoses are placed on opposite sides of the fuel dispensing unit. That is to say, one of the hoses is placed adjacent to said first outer end of said frame element and one of the hoses is placed adjacent to said second outer end of said frame element.

In another embodiment of the invention, the first hose guiding means and the second hose guiding means may be arranged adjacent to the same outer end of said frame element. Here, the same elastic element is used to handle two different hoses of the fuel dispensing unit, wherein the hoses are placed on the same side of the fuel dispensing unit. That is to say, both hoses are placed adjacent to either said first outer end of said frame element or adjacent to said second outer end of said frame element.

The device may further comprise a second guiding element, wherein said first guiding element is arranged at said first outer end of said frame element and said second guiding element is arranged at said second outer end of said frame element, and wherein said elastic element extends from said second fastening point positioned in said second outer end of said frame element, in a substantially horizontal direction, to and around said first guiding element, in a substantially horizontal direction, to and around said second guiding element, in a substantially horizontal direction, to said first fastening point on said first hose guiding means. This is a preferred embodiment of the invention when only one hose is to be handled by the device.

The device may further comprise a second guiding element, wherein said first guiding element is arranged at said first outer end of said frame element and said second guiding element is arranged at said second outer end of said frame element, and wherein said elastic element extends from said second fastening point positioned on said second hose guiding means, in a substantially horizontal direction, to and around said first guiding element, in a substantially horizontal direction, to and around said second guiding element, in a substantially horizontal direction, to said first fastening point on said first hose guiding means. This is a preferred embodiment of the invention when two hoses are to be handled by the device, and where these two hoses are provided on opposite sides of the fuel dispensing unit.

The device may further comprise a second guiding element, wherein said first guiding element is arranged at said first outer end of said frame element and said second guiding element is arranged at said second outer end of said frame element, and wherein said elastic element extends from said first fastening point positioned on said first hose guiding means, in a substantially horizontal direction, to and around said second guiding element, in a substantially horizontal direction, to and around said first guiding element, to said second fastening point on said second hose guiding means. This is a preferred embodiment of the invention when two hoses are to be handled by the device, and where these two hoses are provided on the same side of the fuel dispensing unit.

The first guiding element and the second guiding element may be arranged at different planes in a vertical direction of the frame element. Such a construction will make the device even more space efficient which in turn will lead to the possibility of adding further components into the frame element such that a lager amount of hoses may be handled by means of the same device. To clarify, the different guiding element may be arranged on different positions in a height direction of the frame element. This means that independent on how the frame element is placed in relation to the ground, the guiding element may be arranged on different positions in relation to each other in the direction extending substantially perpendicular and upwards from said ground.

The frame element may be a top module of a fuel dispensing unit. The advantages of this solution are apparent to a person skilled in the art. By limiting the hose handling device to the space of the top module of a fuel dispensing unit, the remaining part of the fuel dispensing unit will have more free space to be used in any suitable way. Also, the risk of any components of the device entangling with hose or hoses are completely eliminated.

In a especially preferred embodiment of the invention, the elastic element may be chosen from the group consisting of a rubber band, a spring wire, wire connected to a spring, and a roll of spring-loaded coiled wire. Further, the first and second guiding elements, respectively, may comprise a roller rotatable on an axis, and the first hose guiding means and the second hose guiding means may each be adapted to enclose a hose.

According to a second aspect, these and other objects are achieved, in full or at least in part, by a fuel dispensing unit for refueling a vehicle, comprising at least one device according the feature described above.

It should be noted that the different embodiments of the device that is described above are exemplifying only. The embodiments may be combined with each other in any suitable way depending on the requirements established for the fuel dispensing unit and on how many hoses the device is handling. Anywhere between one and eight hoses may be handled by the device according to the invention.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

By the term "horizontally" it is meant the horizontal direction of the device or the fuel dispensing unit when standing on a ground.

By the term "vertical direction" it is meant the vertical direction of the device or the fuel dispensing unit when standing on a ground.

BRIEF DESCRIPTION OF THE DRAWINGS

The above objects, as well as additional objects, features and advantages of the present invention, will be more fully appreciated by reference to the following illustrative and non-limiting detailed description of preferred embodiments of the present invention, when taken in conjunction with the accompanying drawings, wherein.

DETAILED DESCRIPTION OF PREFERRED EMBODIMENTS OF THE INVENTION

Figure 1A:
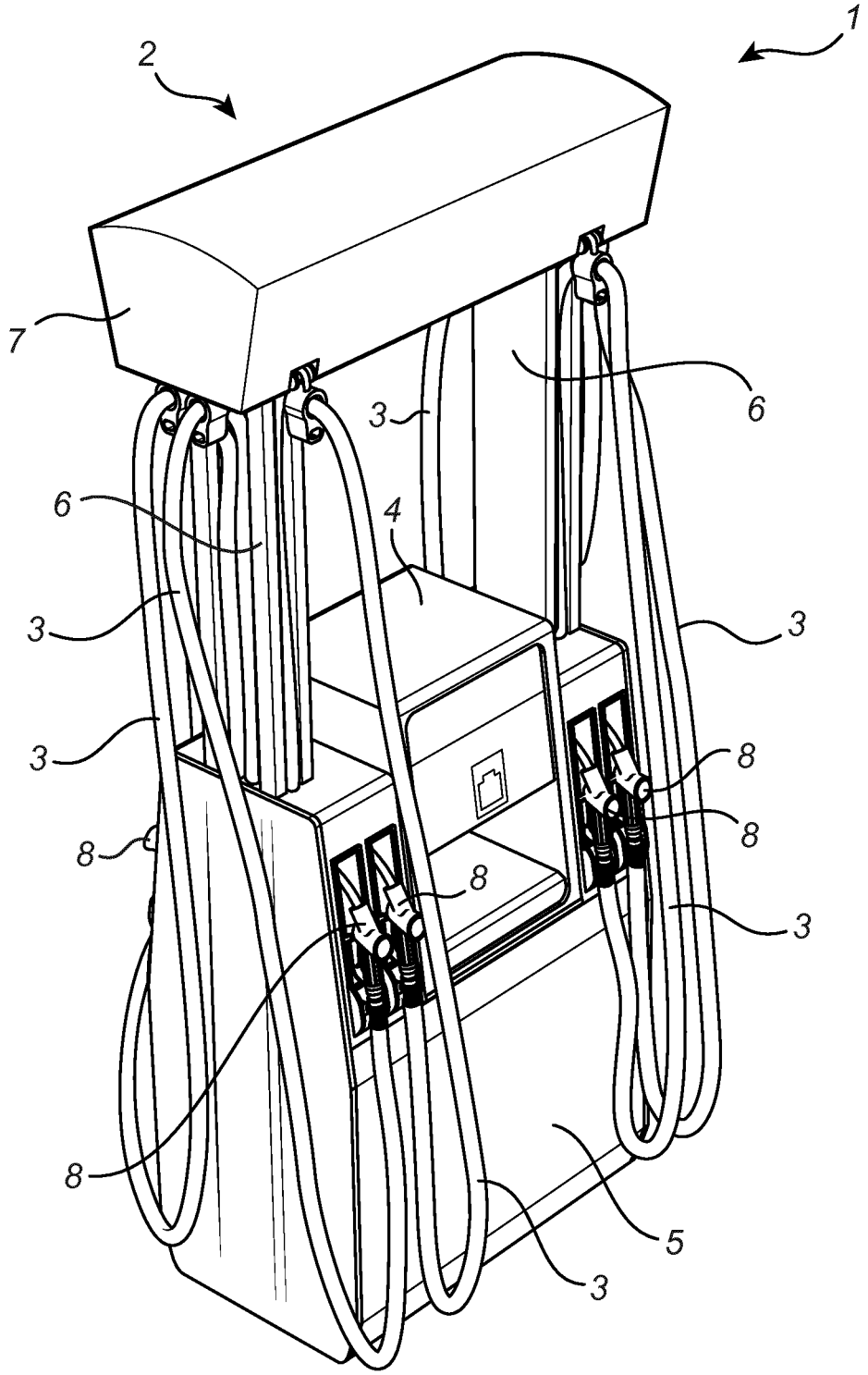
FIG. 1*a* is a perspective view of a fuel dispensing unit having a device according to one exemplary embodiment of the invention. All of the hoses of the fuel dispensing unit are in their idle position.

FIG. 1*a* illustrates a fuel dispensing unit 1 having a device 2 for handling eight hoses 3, four hoses 3 provided on each side of the fuel dispensing unit 1. Here, all of the hoses 3 of the fuel dispensing unit 1 are in their idle position. The fuel dispensing unit 1 has an electrical cabinet 4 containing all the electronics for the fuel dispensing unit 1, a hydraulic cabinet 5 containing fuel dispensing means (not shown), e.g. fuel metering means, valves, vapor recovery system etc, and a column 6 (on each side of the fuel dispensing unit 1) extending upwards vertically above the electrical cabinet 4. The columns 6 are supporting a frame element 7 which is the upper part of the fuel dispensing unit 1. The device 2 is in turn provided in the frame element 7. The fuel dispensing unit 1 is connected to an underground reservoir (not shown) containing fuel. When filling up the tank of a motor vehicle, the fuel is pumped from the underground reservoir by means of a pump (not shown) which is located in the hydraulic cabinet 4, and from there to a hose connection (not shown) and out to a nozzle 8 via the hose 3.

Figure 1B:
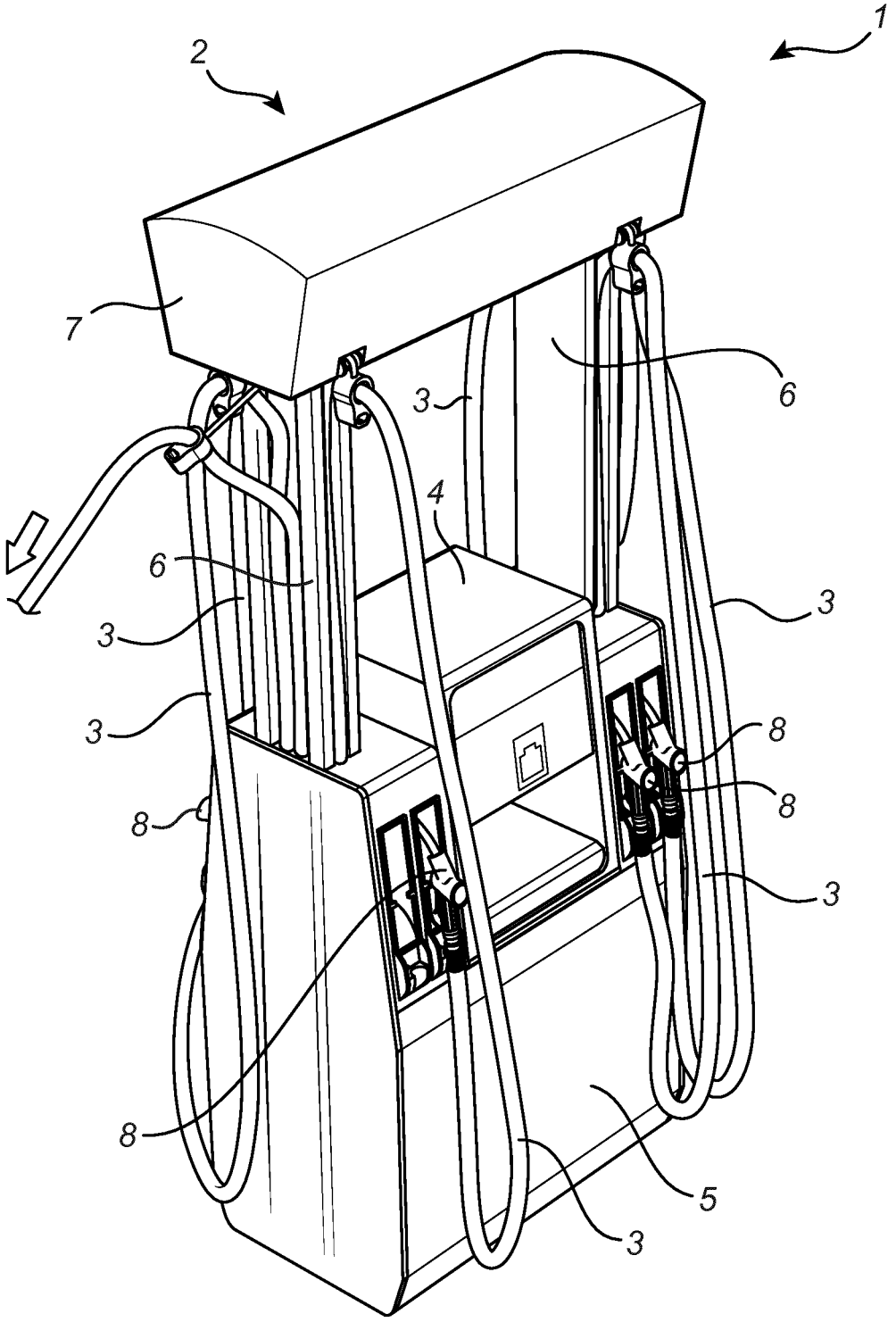
FIG. 1*b* is a perspective view of the fuel dispensing unit in FIG. 1*a*. Here, one of the hoses of the fuel dispensing unit is in its operating position.

In FIG. 1*b*, the fuel dispensing unit 1 of FIG. 1*a* is illustrated. Here, however, one of the hoses of the fuel dispensing unit is in its operating position.

In the following embodiments of the invention, the frame element 7 is constituted by a top module of the fuel dispensing unit 1.

Figure 2:
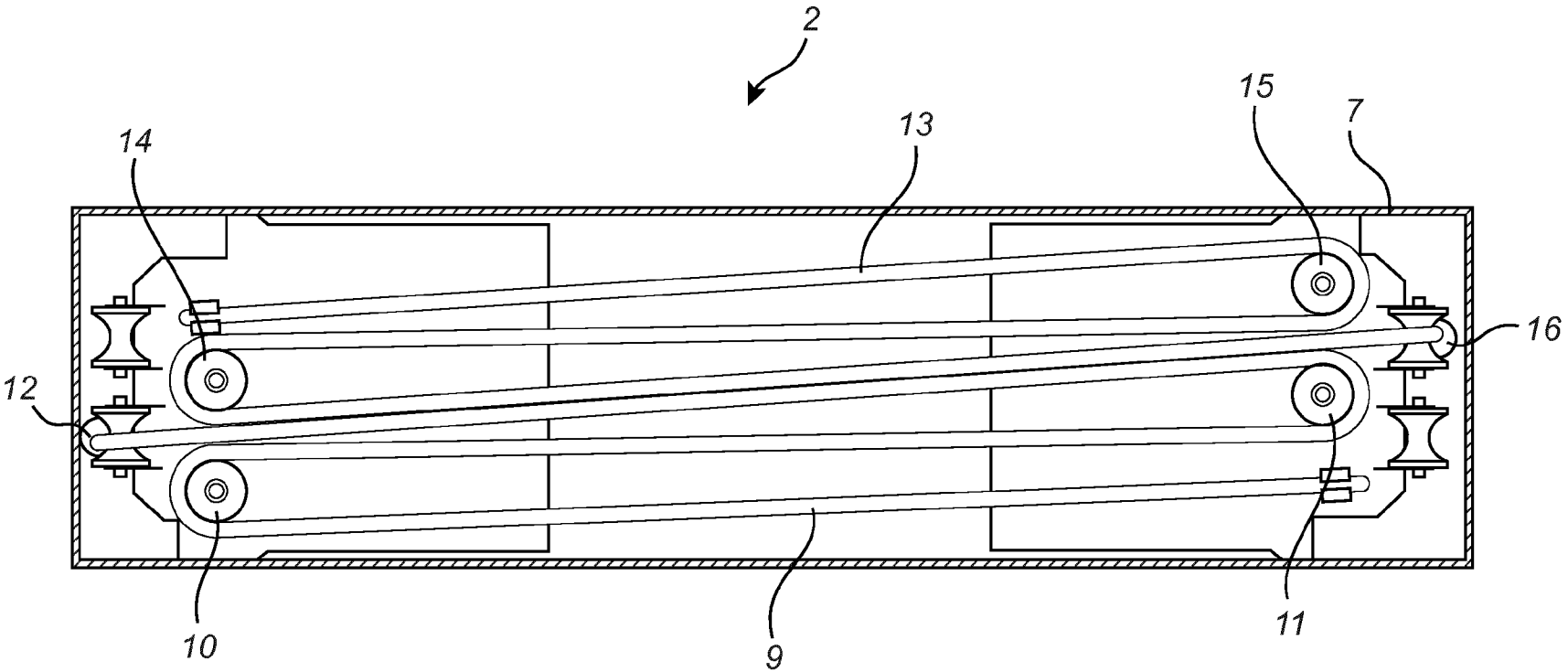
FIG. 2 is a top view of the device according to one embodiment of the invention.

FIG. 2 illustrates the device 2 according to one exemplary embodiment of the invention. In this particular embodiment, the device 2 is handling two hoses 3, one on each side of the fuel dispensing unit 1. The device 2 has a first elastic element 9 which is attached to the top module 7. The first elastic element 9 extends horizontally in said top module 7 from a first fastening point to a second fastening point and is guided by a first guiding element 10 and a second guiding element 11. The first guiding element 10 is provided in a first outer end of the top module 7 and the second guiding element 11 is provided in a second outer end of the top module 7. The first fastening point is positioned on a first hose guiding means 12 and the second fastening point is a fixed point in the top module 7. The first elastic element 9 extends from the second fastening point positioned in the second outer end of the top module 7, horizontally, to and around the first guiding element 10, horizontally, to and around the second guiding element 11, horizontally, to the first fastening point on the first hose guiding means 12. The first hose guiding means 12 is arranged adjacent to the first outer end of the top module 7 and adapted to guide one of the two hoses 3. Thus, the first hose guiding means 12 is movable away from top module 7 allowing the hose 3 to be pulled from an idle position to an operating position.

The device 2 further has a second elastic element 13 which is attached to the top module 7. The second elastic element 13 extends horizontally in said top module 7 from a first fastening point to a second fastening point and is guided by a third guiding element 14 and a fourth guiding element 15. The third guiding element 14 is provided in the first outer end of the top module 7 and the fourth guiding element 15 is provided in the second outer end of the top module 7. The first fastening point is a fixed point in the top module 7 and the second fastening point is positioned on a second hose guiding means 16. The second elastic element 13 extends from the first fastening point positioned in the first outer end of the top module 7, horizontally, to and around the fourth guiding element 15, horizontally, to and around the third guiding element 14, horizontally, to the first fastening point on the second hose guiding means 16. The second hose guiding means 16 is arranged adjacent to the second outer end of the top module 7 and adapted to guide other one of the two hoses 3. Thus, the second hose guiding means 16 is movable away from top module 7 allowing the hose 3 to be pulled from an idle position to an operating position.

In order to ensure a exit of the elastic elements 9, 13 out of the top module 7, the device may further comprise a roller or the like for each elastic element 9, 13 over which the elastic element 9, 13 extends before attaching to the hose guiding means 12, 16.

Figure 3:
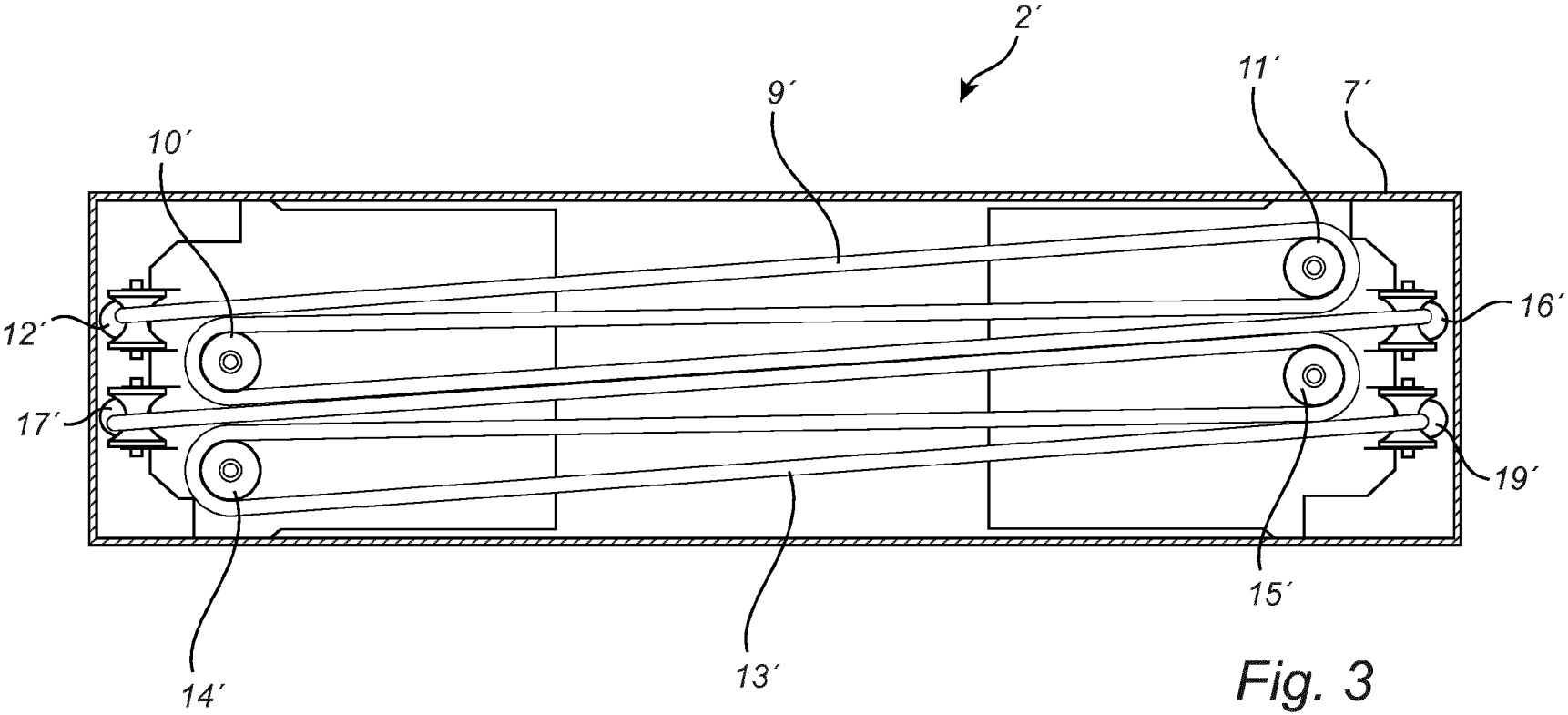
FIG. 3 is a top view of the device according to another embodiment of the invention.

In FIG. 3, the device 2' according to another exemplary embodiment of the invention is illustrated. In this particular embodiment, the device 2' is handling four hoses 3', two on each side of the fuel dispensing unit 1. The device 2 has a first elastic element 9'. The first elastic element 9' extends horizontally in said top module 7' from a first fastening point to a second fastening point and is guided by a first guiding element 10' and a second guiding element 11'. The first guiding element 10' is provided in a first outer end of the top module 7' and the second guiding element 11' is provided in a second outer end of the top module 7'. The first fastening point is positioned on a first hose guiding means 12' and the second fastening point is a second hose guiding means 16'. The first elastic element 9' extends from the first fastening point positioned on the first hose guiding means 12', horizontally, to and around said second guiding element 11', to and around said first guiding element 10', horizontally, to said second fastening point on said second hose guiding means 16'. The first hose guiding means 12' is arranged adjacent to the first outer end of the top module 7' and adapted to guide one of the four hoses 3'. Thus, the first hose guiding means 12' is movable away from top module 7' allowing the hose 3' to be pulled from an idle position to an operating position. The second hose guiding means 16' is arranged adjacent to the second outer end of the top module 7' and adapted to guide one of the four hoses 3'. Thus, the second hose guiding means 16' is movable away from top module 7' allowing the other hose 3' to be pulled from an idle position to an operating position.

The device 2' further has a second elastic element 13'. The second elastic element 13' extends horizontally in said top module 7' from a first fastening point to a second fastening point and is guided by a third guiding element 14' and a fourth guiding element 15'. The third guiding element 14' is provided in the first outer end of the top module 7' and the fourth guiding element 15' is provided in the second outer end of the top module 7'. The first fastening point is positioned on a third hose guiding means 17' and the second fastening point is a fourth hose guiding means 19'. The second elastic element 13' extends from the first fastening point positioned on the third hose guiding means 17', horizontally, to and around said fourth guiding element 15', horizontally, to and around said third guiding element 14', horizontally, to said second fastening point on said fourth hose guiding means 19'. The third hose guiding means 17' is arranged adjacent to the first outer end of the top module 7' and adapted to guide yet another one of the four hoses 3'. Thus, the third guiding means 17' is movable away from top module 7' allowing the hose 3' to be pulled from an idle position to an operating position. The fourth hose guiding means 19' is arranged adjacent to the second outer end of the top module 7' and adapted to guide yet another one of the four hoses 3'. Thus, the fourth hose guiding means 19' is movable away from top module 7' allowing the other hose 3' to be pulled from an idle position to an operating position.

In order to ensure a exit of the elastic elements 9', 13' out of the top module 7', the device may further comprise a roller 17' or the like for each elastic element 9', 13' over which the elastic element 9', 13' extends before attaching to the hose guiding means 12', 16', 17', 19'.

Figure 4:
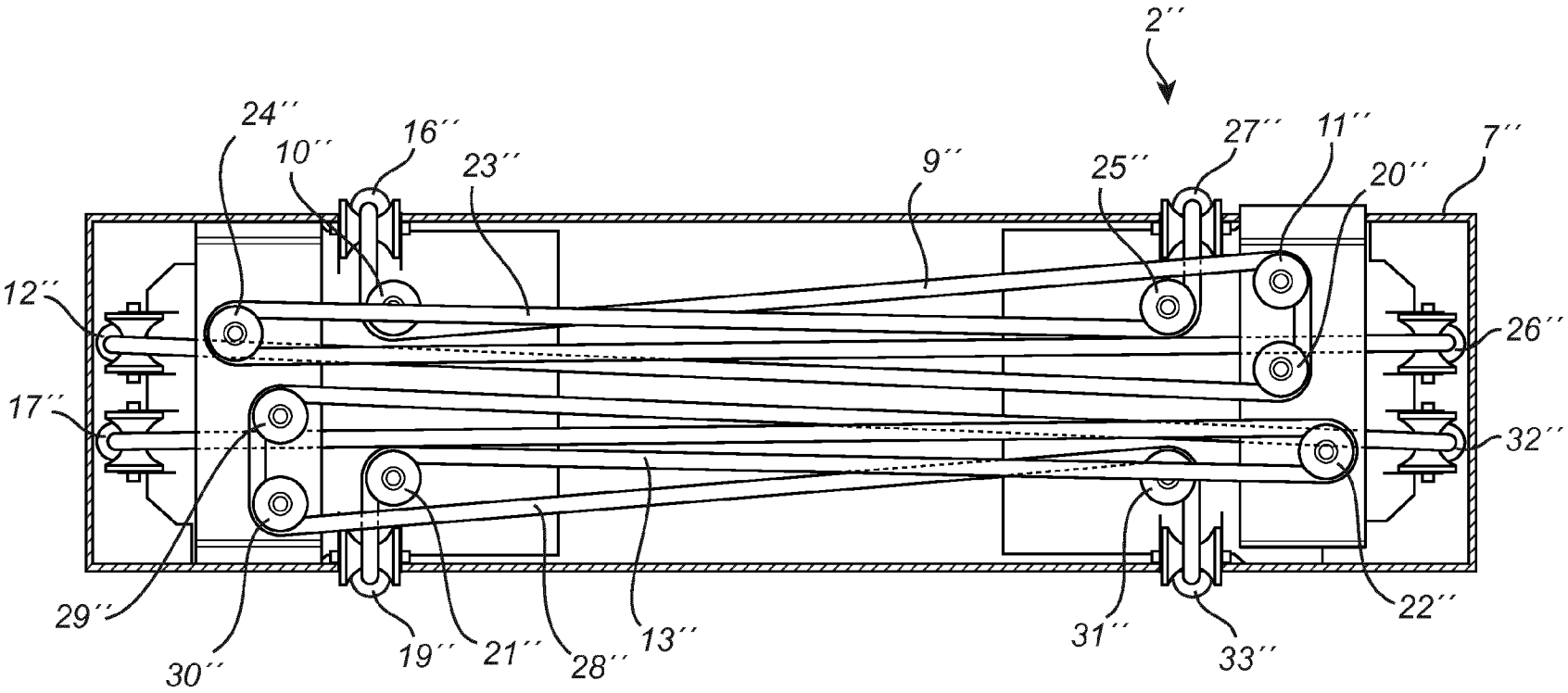
FIG. 4 is a top view of the device according to yet another embodiment of the invention.

FIG. 4 illustrates the device 2" according to another exemplary embodiment of the invention is illustrated. In this particular embodiment, the device 2" is handling eight hoses 3", four on each side of the fuel dispensing unit 1. The device 2" has a first elastic element 9". The first elastic element 9" extends horizontally in said top module 7" from a first fastening point to a second fastening point and is guided by a first guiding element 10", a second guiding element 11' and a third guiding element 20". The first guiding element 10" is provided in the first outer end of the top module 7", the second guiding element 11" is provided in the second outer end of the top module 7' and the third guiding element 20" is also provided in the second outer end of the top module 7". The first fastening point is positioned on a first hose guiding means 12" and the second fastening point is a second hose guiding means 16". The first elastic element 9" extends from the first fastening point positioned on the first hose guiding means 12", horizontally, to and around said third guiding element 20" and said second guiding element 11", horizontally, to and around said first guiding element 10", to said second fastening point on said second hose guiding means 16". The first hose guiding means 12" is arranged adjacent to the first outer end of the top module 7" and adapted to guide one of the eight hoses 3". Thus, the first hose guiding means 12" is movable away from top module 7" allowing the hose 3" to be pulled from an idle position to an operating position. The second hose guiding means 16" is also arranged adjacent to the first outer end of the top module 7" and adapted to guide another one of the eight hoses 3". Thus, the second hose guiding means 16" is movable away from top module 7" allowing the other hose 3" to be pulled from an idle position to an operating position. Here, the first guiding element 10" is arranged at a different plane, in a vertical direction, of the top module 7" compared to the second guiding element 11" and the third guiding element 20". The second guiding element 11" and a third guiding element 20" are, however, arranged in the same vertical plane.

The device 2" further has a second elastic element 13". The second elastic element 13' extends horizontally in said top module 7" from a first fastening point to a second fastening point and is guided by a fourth guiding element 21" and a fifth guiding element 22". The fourth guiding element 21" is provided in the first outer end of the top module 7" and the fifth guiding element 22" is provided in the second outer end of the top module 7". The first fastening point is positioned on a third hose guiding means 17" and the second fastening point is a fourth hose guiding means 19". The second elastic element 13" extends from the first fastening point positioned on the third hose guiding means 17", horizontally, to and around said fifth guiding element 22", horizontally, to and around said fourth guiding element 21", to said second fastening point on said fourth hose guiding means 19". The third hose guiding means 17" is arranged adjacent to the first outer end of the top module 7' and adapted to guide yet another one of the eight hoses 3". Thus, the first guiding means 17" is movable away from top module 7" allowing the hose 3" to be pulled from an idle position to an operating position. The fourth hose guiding means 19" is also arranged adjacent to the first outer end of the top module 7" and adapted to guide yet another one of the eight hoses 3". Thus, the fourth hose guiding means 19" is movable away from top module 7" allowing the other hose 3" to be pulled from an idle position to an operating position. Here, the fourth guiding element 21" is arranged at a different plane, in a vertical direction, of the top module 7" compared to the fifth guiding element 22".

The device 2" further has a third elastic element 23". The second elastic element 23" extends horizontally in said top module 7' from a first fastening point to a second fastening point and is guided by a sixth guiding element 24" and a seventh" guiding element 25". The sixth guiding element 24" is provided in the first outer end of the top module 7" and the seventh guiding element 25" is provided in the second outer end of the top module 7". The first fastening point is positioned on a fifth hose guiding means 26" and the second fastening point is a sixth hose guiding means 27". The third elastic element 23" extends from the first fastening point positioned on the fifth hose guiding means 26", horizontally, to and around said sixth guiding element 24", horizontally, to and around said seventh guiding element 25", to said second fastening point on said sixth hose guiding means 27". The fifth hose guiding means 26" is arranged adjacent to the second outer end of the top module 7" and adapted to guide yet another one of the eight hoses 3". Thus, the fifth guiding means 26" is movable away from top module 7" allowing the hose 3" to be pulled from an idle position to an operating position. The sixth hose guiding means 27" is also arranged adjacent to the second outer end of the top module 7" and adapted to guide yet another one of the eight hoses 3". Thus, the sixth hose guiding means 27" is movable away from top module 7" allowing the other hose 3" to be pulled from an idle position to an operating position. Here, the sixth guiding element 24" is arranged at a different plane, in a vertical direction, of the top module 7" compared to the seventh guiding element 25".

The device 2" further has a fourth elastic element 28". The fourth elastic element 28" extends horizontally in said top module 7" from a first fastening point to a second fastening point and is guided by an eight guiding element 29", a ninth guiding element 30" and a tenth guiding element 31". The eight guiding element 29" and the ninth guiding element 30" are provided in the first outer end of the top module 7", the tenth guiding element 31" is provided in the second outer end of the top module 7". The first fastening point is positioned on a seventh hose guiding means 32" and the second fastening point is an eight hose guiding means 33". The fourth elastic element 28" extends from the first fastening point positioned on the seventh hose guiding means 32", horizontally, to and around said eight guiding element 29" and said ninth guiding element 30", horizontally, to and around said tenth guiding element 31", to said second fastening point on said eight hose guiding means 33". The seventh hose guiding means 32" is arranged adjacent to the second outer end of the top module 7" and adapted to guide yet another one of the eight hoses 3". Thus, the seventh hose guiding means 32" is movable away from top module 7" allowing the hose 3" to be pulled from an idle position to an operating position. The eight hose guiding means 33" is also arranged adjacent to the second outer end of the top module 7" and adapted to guide another one of the eight hoses 3". Thus, the eight hose guiding means 3" is movable away from top module 7" allowing the other hose 3" to be pulled from an idle position to an operating position. Here, the eight guiding element 29" and the ninth guiding element 30 are arranged at a different plane, in a vertical direction, of the top module 7" compared to the tenth guiding element 31". The eight guiding element 29" and the ninth guiding element 30" are, however, arranged in the same vertical plane.

In order to ensure a exit of the elastic elements 9", 13", 23", 28" out of the top module 7', the device may further comprise a roller 17' or the like for each elastic element 9", 13", 23", 28" over which the elastic element 9", 13", 23", 28" extends before attaching to the hose guiding means 12", 16", 17", 19", 26", 27", 32", 33".

Further, with the embodiment illustrated in FIG. 4, each pair of hoses 3" being handled by the same elastic element 9", 13", 23", 28" are connected to the same pump and are provided on the same side of the fuel dispensing unit. This means that only one of each pair of hoses 3" will be used at the time and thus there will be no conflict between the pair of hoses 3".

On a general note, a fuel dispensing unit equipped with a device according to the present invention will function according to the following. When the hose is to be used to refuel a vehicle, the hose is merely pulled by a user. The hose guiding means will follow the hose and move away from the top module to an operating position, thereby extending the elastic element attached to the same. When the vehicle has been refueled and the user releases the pressure applied to the hose, the elastic element will pull the hose guiding means as well as the hose back to the idle position.

The skilled person realizes that a number of modifications of the embodiments described herein are possible without departing from the scope of the invention, which is defined in the appended claims.

For instance, the elastic elements may be chosen from the group consisting of a rubber band, a spring wire, wire connected to a spring, and a roll of spring-loaded coiled wire.

The guiding elements may, respectively, comprise a roller rotatable on an axis.

The hose guiding means may be adapted to enclose said at least one hose.

Figure 5A:
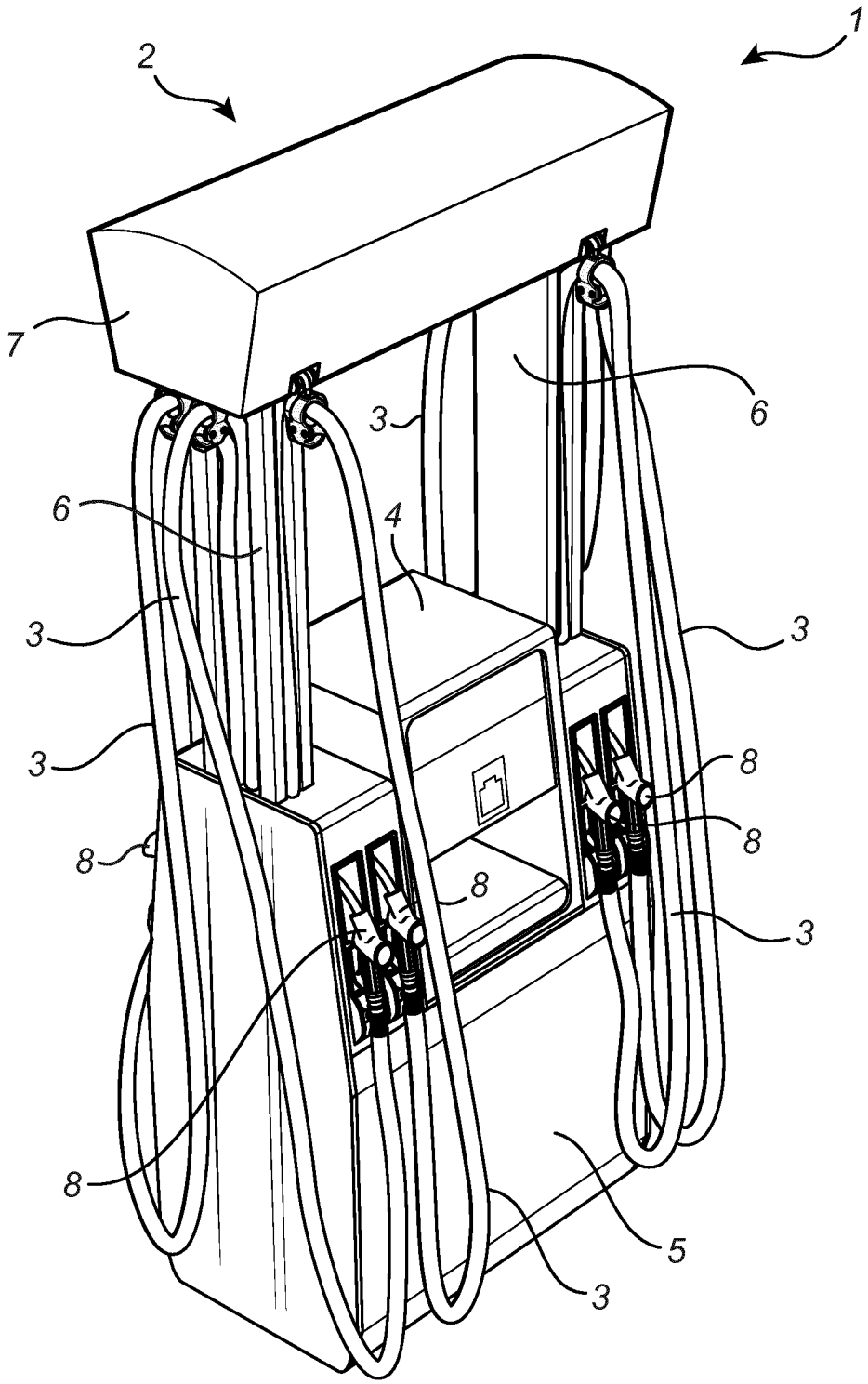
FIG. 5*a* is a perspective view of a fuel dispensing unit having a device according to another exemplary embodiment of the invention. All of the hoses of the fuel dispensing unit are in their idle position.
Figure 5B:
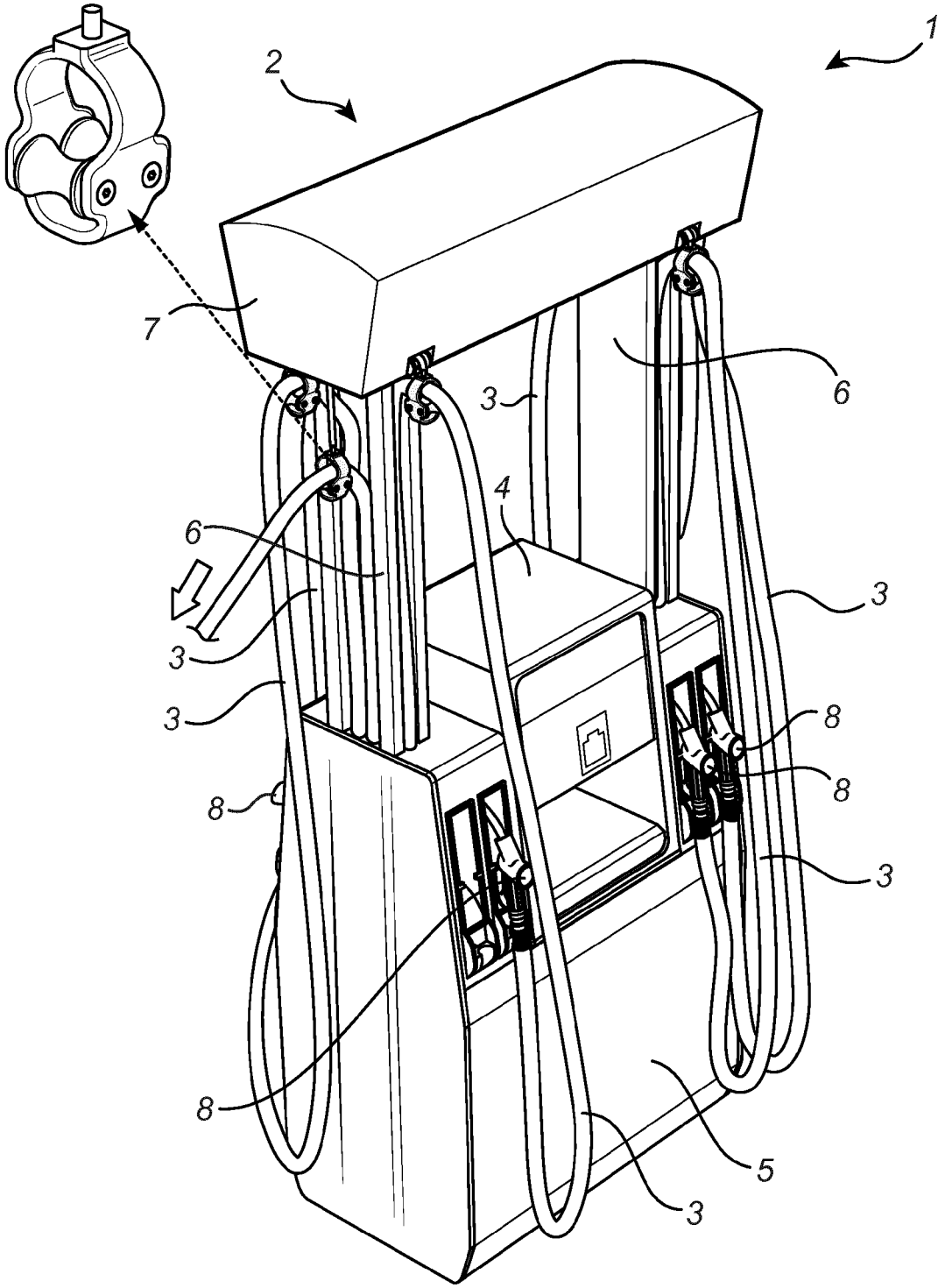
FIG. 5*b* is a perspective view of the fuel dispensing unit in FIG. 5*a*. Here, one of the hoses of the fuel dispensing unit is in its operating position.

The hose guiding means may also be comprised by a sleeve carrying a roller on which the hose may glide. Thus, the sleeve encloses the hose but the hose may still glide in relation to the hose guiding means due to the roller. The embodiment is illustrated in FIG. 5*a*, when the hose is in its idle position, and in FIG. 5*b*, when the hose is in its operating position. The advantage with this construction is that the elastic element attached to the hose guiding means will not be pulled out of the top module to the same extent as if the hose guiding means was fixedly attached to the hose.

The invention claimed is:

1. A device for handling at least one hose, comprising:

a frame element being hollow and having a first outer end and a second outer end, said second outer end being opposite to said first outer end;

a first guiding element arranged in the frame element;

an elastic element extending horizontally in the frame element from a first fastening point to a second fastening point, the elastic element being guided by the first guiding element; and a first hose guide arranged adjacent to the first outer end of the frame element and configured to guide the at least one hose, wherein the first fastening point is positioned on the first hose guide such that the first hose guide is movable away from the frame element allowing the at least one hose to be pulled from an idle position to an operating position, and the second fastening point is positioned on a second hose guide for guiding a second hose such that the second hose guide is movable away from the frame element allowing the second hose to be pulled from an idle position to an operating position.

2. The device of claim 1, wherein the second hose guide is arranged adjacent to the second outer end of the frame element.

3. The device of claim 2, further comprising a second guiding element, wherein the first guiding element is arranged at the first outer end of the frame element and the second guiding element is arranged at the second outer end of the frame element, and wherein the elastic element extends from the first fastening point positioned on the first hose guide, horizontally, to and around the second guiding element, horizontally, to and around the first guiding element, horizontally, to the second fastening point on the second hose guide.

4. The device of claim 1, wherein the first hose guide and the second hose guide are arranged adjacent to the same outer end of the frame element.

5. The device of claim 1, further comprising a second guiding element, wherein the first guiding element is arranged at the first outer end of the frame element and the second guiding element is arranged at the second outer end of the frame element, and wherein the elastic element extends from the second fastening point, horizontally, to and around the first guiding element, horizontally, to and around the second guiding element, horizontally, to the first fastening point on the first hose guide.

6. The device of claim 5, wherein the first guiding element and the second guiding element are arranged at different planes in a vertical direction of the frame element.

7. The device of claim 1, wherein the frame element is a top module of a fuel dispensing unit.

8. The device of claim 1, wherein the elastic element is selected from the group consisting of a rubber band, a spring wire, wire connected to a spring, and a roll of spring-loaded coiled wire.

9. The device of claim 1, wherein the first guiding element comprises a roller rotatable on an axis.

10. The device of claim 1, wherein the first and second hose guides are adapted to enclose the at least one hose.

11. A fuel dispensing unit for refueling a vehicle, comprising:

a hydraulics cabinet;

an electrical cabinet mounted on the hydraulics cabinet;

first and second columns extending vertically upwards from the hydraulics cabinet above the electrical cabinet;

a top module extending between the first and second columns upward of the electrical cabinet;

a first hose guide at a first end of the top module for guiding a first hose, and a second hose guide at a second end of the top module for guiding a second hose;

at least one guiding element mounted in the top module; and a first elastic element extending horizontally in the frame element from a first fastening point on the first hose guide, around the at least one guiding element, to a second fastening point on the second hose guide, wherein the first hose guide is movable away from the frame element to allow the first hose to be pulled from an idle position to an operating position, and the second fastening point is positioned on the second hose guide to allow the second hose to be pulled from an idle position to an operating position.

12. The fuel dispenser of claim 11, wherein the at least one guiding element comprises a first guiding element and a second guiding element, and the first elastic element extends horizontally from the first fastening point on the first hose guide to and around the second guiding element, and extends horizontally from the second guiding element to and around the first guiding element, and extends horizontally from the first guiding element to the second fastening point on the second hose guide.

13. The fuel dispenser of claim 12, wherein the first guiding element is at the first end of the top module, and the second guiding element is at the second end of the top module.

14. The fuel dispenser of claim 11, further comprising:

a third hose guide at the first end of the top module, and a fourth hose guide at the second end of the top module, the first and second hose guides being movable away from the top module;

at least one guiding element mounted in the top module; and a second elastic element extending horizontally in the frame element from a third fastening point on the third hose guide, to and around the at least one guiding element, and extending from the at least one guiding element, to a fourth fastening point on the fourth hose guide.

15. The fuel dispenser of claim 14, wherein the at least one guiding element comprises a third guiding element and a fourth guiding element, and wherein the second elastic element extends horizontally in the frame element from the third fastening point, to and around the fourth guiding element, and extends horizontally from the fourth guiding element to and around the third guiding element, and extends horizontally from the third guiding element to the fourth fastening point on the fourth hose guide.

16. The fuel dispenser of claim 11, wherein the at least one guiding element comprises a first guiding element and a second guiding element are arranged at different planes in a vertical direction of the top module.

* * * * *